United States Patent [19]

Mahulikar et al.

[11] Patent Number: 4,799,973

[45] Date of Patent: Jan. 24, 1989

[54] PROCESS FOR TREATING COPPER-NICKEL ALLOYS FOR USE IN BRAZED ASSEMBLIES AND PRODUCT

[75] Inventors: Deepak Mahulikar, West Haven; Eugene Shapiro, Hamden, both of Conn.

[73] Assignee: Olin Corporation, New Haven, Conn.

[21] Appl. No.: 596,182

[22] Filed: Apr. 2, 1984

[51] Int. Cl.[4] ..... C22F 1/08; B32B 15/20

[52] U.S. Cl. ..... 148/435; 148/11.5 C; 228/173.6; 228/203; 228/263.18; 428/675

[58] Field of Search ..... 148/11.5 C, 414, 435; 428/675; 228/203, 205, 173 C, 173 F, 263.18

[56] References Cited

U.S. PATENT DOCUMENTS

| | | | |
|---|---|---|---|
| 1,525,047 | 2/1925 | Rath | 420/487 |
| 2,052,139 | 8/1936 | Jennison | 228/263.18 |
| 2,058,887 | 10/1936 | Jennison | 228/263.18 |
| 2,074,604 | 3/1937 | Bolton et al. | 420/487 |
| 2,144,279 | 1/1932 | Whitman | 420/471 |
| 2,215,905 | 9/1940 | Kihlgren | 420/487 |
| 3,053,511 | 9/1962 | Godfrey | 428/675 |
| 3,290,182 | 12/1966 | Eichelman, Jr. | 228/263.18 |
| 3,297,497 | 1/1967 | Eichelman, Jr. et al. | 148/11.5 C |
| 4,169,729 | 10/1979 | Popplewell et al. | 420/471 |

FOREIGN PATENT DOCUMENTS

| | | | |
|---|---|---|---|
| 116846 | 9/1981 | Japan | 420/487 |
| 123846 | 7/1983 | Japan | 420/485 |

OTHER PUBLICATIONS

Metals Handbook, Ninth Edition, vol. 2, Properties and Selections Nonferrous Alloys and Pure Metals, ASM, Metals Park, Ohio, 1979, p. 248.

*Primary Examiner*—Melvyn J. Andrews
*Assistant Examiner*—Robert L. McDowell
*Attorney, Agent, or Firm*—Gregory S. Rosenblatt; Paul Weinstein

[57] ABSTRACT

The present invention relates to a process for maintaining the fine grain size of and providing excellent bend formability, hot ductility and strength properties to a copper-nickel-manganese alloy to be exposed to elevated temperatures. The process of the present invention includes a final cold working step during which the material to be fabricated into a desired article and/or exposed to the elevated temperatures has its thickness reduced by about 4% to about 30%, preferably from about 5% to about 25%. The alloys described herein have particular utility in brazed articles or assemblies.

23 Claims, No Drawings

PROCESS FOR TREATING COPPER-NICKEL ALLOYS FOR USE IN BRAZED ASSEMBLIES AND PRODUCT

This application is related to co-pending U.S. patent application Ser. No. 587,570, filed Mar. 9, 1984, to Mahulikar et al.

The present invention relates to a process for. treating copper-nickel alloys to enable them to retain a relatively fine grain structure and exhibit excellent bend formability, ductility and strength properties after exposure to elevated temperatures.

It is well known that copper-nickel alloys are particularly well adapted for use in those environments where resistance to corrosion and mechanical strength are required. Applications for these alloys include tubing for heat exchangers such as radiators and oil coolers, salt water lines such as fire lines and sanitary lines, sheathing for lifeboats, fuel lines and pressure-containing parts in valves and fittings which are used at elevated temperatures. Often during fabrication into a final product, the alloys are subjected to elevated temperatures such as those associated with brazing. One particular family of copper-nickel alloys that have been used in a variety of applications because of their ductility and ability to withstand high temperatures are copper-nickel-manganese alloys. U.S. Pat. Nos. 1,525,047 to Rath, 2,074,604 to Bolton et al., 2,144,279 to Whitman, 2,215,905 to Kihlgren and 4,169,729 to Popplewell et al. illustrate several copper-nickel-manganese alloys and their applications. In addition to being exposed to elevated temperatures, these copper-nickel-maganese alloys often undergo fabrication operations such as stamping and bending. Consequently, it becomes desirable that the alloy being processed exhibit both good formability and ductility. When fabricated into articles such as tubing, it is also desirable that the alloy exhibit relatively high strength properties.

In order to maintain the lowest possible cost, cupro-nickel strip materials are often processed directly to finish gage and annealed. The materials processed in this manner often show extreme grain growth after exposure to elevated temperatures. It is not unusual for brazed cupro-nickel materials to exhibit grain growth in excess of 2mm. Materials having such a grain size may be undesirably low in strength.

It is an object of the present invention to provide a copper-nickel alloy having the ability to maintain a relatively fine grain structure when exposed to elevated temperatures.

It is a further object of the present invention to provide a copper-nickel alloy as above having improved ductility and bend formability.

It is a further object of the present invention to provide a process for providing such a copper-nickel alloy.

It is a further object of the present invention to provide a copper-nickel alloy as above which has particular utility in brazed assemblies.

Further objects and advantages of the present invention will become apparent from a consideration of the following specification.

Alloys in accordance with the present invention consist essentially of from about 5% to about 45% nickel, from about 0.1% to about 1.1% manganese and the balance essentially copper. The higher nickel contents are generally used where strength is required and/or more aggressive environments are encountered in service. While not mandatory, the alloys may also contain phosphorous in an amount less than about 0.002%. As used herein, the percentages for each addition are weight percentages. In a preferred embodiment, the alloys of the present invention consist essentially of from about 5% to about 35% nickel, from about 0.6% to about 1% manganese and the balance essentially copper.

The alloys may be processed in any desired manner to a strip material having a desired thickness, a desired temper and a desired grain size. Preferably, the strip material possesses an average grain size of about 10μ to about 100μ prior to the treatment of the present invention. In accordance with the present invention, the strip material is then subjected to a final cold working step which reduces its thickness from about 4% to about 30%. It has been discovered that such a final cold working step enables the material to substantially maintain a relatively fine grain structure when exposed to elevated temperatures during subsequent processing. This is surprising because relatively low reductions normally cause exaggerated grain growth during conventional heat treatments such as annealing. As well as maintaining a relatively fine grain structure, alloys processed in accordance with the present invention exhibit excellent bend formability, ductility and strength during and after exposure to elevated temperatures. This combination of properties and grain structure is highly desirable in a material to be brazed.

In a preferred manner of performing the present invention, the final cold working step is performed by cold rolling the strip material in a single pass through a rolling mill to obtain the strip material thickness reduction. In a most preferred embodiment, the final cold working step comprises reducing the strip material thickness by about 5% to about 25%.

Alloys processed in accordance with the present invention have utility in assemblies subjected to high temperature processes and techniques, particularly brazed assemblies. Good brazing materials need to exhibit good bend formability, hot ductility and strength properties. Alloys processed in accordance with the present invention exhibit such properties. In addition, alloys processed in accordance with the present invention are able to substantially maintain relatively fine grain structures after exposure to elevated temperatures. This is directly attributable to the final cold working step which acts as a grain refinement treatment.

As previously discussed, alloys in accordance with the present invention consist essentially of from about 5% to about 45% nickel, from about 0.1% to about 1.1% manganese and the balance essentially copper. In a preferred embodiment, the copper-base alloys consist essentially of from about 5% to about 35% nickel, from about 0.6% to about 1% manganese and the balance essentially copper. If desired, the alloys may contain phosphorous in an amount less than about 0.002%; however, this is not required. Conventional brass mill impurities may be tolerated in the alloys of the present invention but should preferably be kept at a minimum.

Ordinarily, copper nickel alloys that are exposed to high temperatures such as those associated with brazing experience grain coarsening. This grain coarsening adversely impacts the material and reduces the overall strength of the material. It has been found that alloys processed in accordance with the process of the present invention are able to maintain relatively fine grain structures after exposure to elevated temperatures. As a result, the alloys exhibit improved strength and improved ductility at elevated temperatures. The improved ductility is particularly desirable because greater elongation percentages may be obtained at the elevated temperatures. As a result, cracking in assemblies subjected to relatively high temperature heat treatments such as brazing is significantly reduced.

As well as exhibiting improved strength and ductility, alloys processed in accordance with the present invention exhibit excellent bend formability. This is particularly desirable where the material is to be subjected during fabrication to forming operations such as stamping and bending. For good bend formability, a minimum bend radius of 1t is desirable where t is the thickness of the material being bent.

The alloys of the present invention may be cast in any desired manner. For example, they may be cast using continuous casting, direct chill casting or Durville casting. Any suitable pouring temperature may be used during casting. Generally, the pouring temperature will preferably be in the range of about 1000° C. to about 1300° C. Most preferably, the pouring temperature is in the range of about 1050° C. to about 1150° C.

After casting, the alloys may be processed in any desired manner into a strip material having a desired thickness, a desired temper and a desired grain structure. In a preferred embodiment, the strip material has an average grain size in the range of about 10μ to about 100μ. Preferably, the alloys will be processed by breaking down the cast ingot into a strip material such as a sheet or plate using a hot working operation such as hot rolling followed by a cold working operation such as cold rolling. During cold rolling, the alloy may be subjected to one or more passes through a rolling mill until it reaches the desired thickness or gage. If necessary, one or more interanneals may be performed during the cold rolling operation. To provide the desired temper, the strip material may be annealed after cold working to the desired thickness. The various hot rolling, cold rolling and/or annealing steps may be performed using any conventional technique and apparatus known in the art.

The hot rolling step may be performed with any suitable initial temperature. Preferably, the initial hot rolling temperature is in the range of about 700° C. to about 1050° C. Most preferably, the initial hot rolling temperature is in the range of about 780° C. to about 1000° C. Any suitable cooling rate may be used to cool the strip material from hot rolling.

The alloys of the present invention are believed to be capable of cold rolling reductions in excess of 90%; however, the cold rolling reduction preferably is between 10% and 80%. The cold rolling operation may be performed in one or more rolling passes.

Annealing temperatures in the range of about 550° C. to about 900° C. for at least one minute to about 24 hours may be used for the interanneals and/or the final anneal to a desired temper. Preferably, the final anneal and/or the interanneals are performed at an annealing temperature in the range of about 700° C. to about 850° C. for at least about one hour to about 12 hours.

After the strip material has been processed to have a desired thickness, a desired temper and a desired grain structure, it is subjected to a final cold working step. The final cold working step preferably reduces the strip material thickness from about 4% to about 30%. In a most preferred embodiment, the strip material thickness is reduced from about 5% to about 25%. The final cold working step may be performed in any desired manner using any conventional technique and apparatus known in the art. Preferably, the cold orking step comprises cold rolling the strip material to obtain the reduction in thickness. The cold rolling step may be performed by one or more passes of the strip material through a conventional rolling mill.

It has been discovered that performing this final cold working step as the last processing step before fabrication into a desired article and/or exposure to elevated temperatures enables the copper alloys of the present invention to maintain a relatively fine grain structure. It is believed that grain structures having an average grain size in the range of about 100μ to about 200μ are achievable using the final cold working step of the present invention. Further, alloys processed in accordance with the present invention exhibit excellent bend formability, hot ductility and strength before, during and after exposure to elevated temperatures. This renders the alloys particularly suitable for use in brazed assemblies such as tubing for radiators or heat exchangers.

After the processing has been completed, the strip material may be fabricated into any desired article. As previously stated, alloys processed in accordance with the present invention readily lend themselves for use in brazed assemblies such as tubing. When used in such assemblies, the alloys of the present invention demonstrate excellent brazing characteristics and may be used with any suitable filler material. For example, they may be used with filler materials such as copper alloys C11000 and C12200. Of course, the temperatures used in brazing depend upon the filler material being used. For copper alloys such as C11000 and C12200, the brazing temperature is typically in the range of about 1065° C. to about 1120° C., generally about 1090° C. At these temperatures, alloys processed in accordance with the present invention are able to maintain relatively fine grain structures as well as excellent ductility, formability and strength properties. It should be noted that the ductility at elevated temperatures property, or hot ductility, exhibited by the present alloys facilitate fabrication operations in general.

The present invention and improvements resulting therefrom will be more readily apparent from a consideration of the following illustrative examples.

EXAMPLE I

Two alloys were prepared having the nominal compositions set forth in Table I below.

TABLE I

| Alloy | Ni (%) | Mn (%) | Cu (%) |
|---|---|---|---|
| A | 21 | 0.6 | bal. |
| B | 21 | 1.0 | bal. |

The alloys were Durville cast and processed in the following manner. The alloys were soaked at 980° C. for 40 minutes and then hot rolled to 0.3". The plates were then coil milled and cold rolled down to 0.050" gage. Samples of each alloy were then given one of the following three treatments.

The first treatment comprised further cold rolling the samples down to 0.020" gage and then annealing each sample at 700° C. for 1 hour to a soft temper. The second treatment comprised cold rolling the samples down to 0.020" gage, annealing each sample at 700° C. for 1 hour to a soft temper and performing a final 10% cold reduction. The third treatment comprised first annealing each sample at 700° C. for 1 hour and then performing the second treatment. All of the treated samples were then braze heat treated at 1090° C. for 30 minutes and the grain size was recorded. The brazing heat treatment consisted of placing the test samples in a chamber and heating them to the desired temperature.

The results of the grain size measurements are recorded in Table II.

TABLE II

| Treatment | Alloy | Grain Size After Brazing Heat Treatment (mm) |
|---|---|---|
| 1 | A | >1 |
| 1 | B | >1 |
| 2 | A | ~0.2 |
| 2 | B | ~0.2 |
| 3 | A | ~0.2 |
| 3 | B | ~0.2 |

From this data, it can be seen that treatment 1 resulted in excessive undesirable grain growth whereas the alloys processed by treatments 2 and 3 exhibted a fine grain structure. The data also shows that the grain refinement effect after brazing using the final cold working step of the present invention may be obtained irrespective of the number of previous anneals employed.

EXAMPLE II

To demonstrate the bend formability properties of materials treated in accordance with the present invention, bend formability tests were carried out on a manganese modified copper-nickel alloy. The alloy had the same nominal composition as alloy B in Example I.

Samples of the alloy were given different final cold reductions ranging from 5% to 37%. Thereafter, standard 90° bend tests were carried out in good and bad way directions. The results are given in Table III.

TABLE III

| Cold Rolling (%) | 5 | 10 | 20 | 25 | 37 |
|---|---|---|---|---|---|
| Minimum Bend Radius/Thickness (L)* | sharp | sharp | 0.55 | 0.6 | 0.7 |
| Minimum Bend Radius/Thickness (T)** | sharp | 0.24 | 0.55 | 0.6 | 1.4 |

*(L) = good way
**(T) = bad way

For good bend formability, a minimum bend radius of 1t is the maximum limit where t is the thickness of the material being tested. The results at the 5%, 10%, 20% and 25% cold reductions were acceptable while the results at the 37% cold reduction were unacceptable.

It is believed that thsse examples demonstrate the benefits, e.g. improved ductility, bend formability and strength, the ability to maintain a fine grain structure when exposed to elevated temperatures and improved brazing ability which can be obtained by processing copper-nickel-manganese alloys in accordance with the present invention. Alloys processed in accordance with the present invention readily lend themselves to applications, such as tubing for heat exchangers, radiators, and transmission oil coolers, where such properties are required.

While the nickel content of the alloys of the present invention has been described as being from about 5% to about 45%, the nickel content may be as great as about 65% without adversely affecting the desirable properties of the alloys.

The U.S. patents set forth in the application are intended to be incorporated by reference herein.

It is apparent that there has been provided in accordance with this invention a process for treating copper-nickel alloys for use in brazed assemblies which fully satisfy the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A process for providing a copper-nickel alloy capable of maintaining its bend formability properties and a relatively fine grain structure when exposed to elevated temperatures, said process comprising:

providing a copper-nickel alloy having a first thickness, a desired temper and a desired grain size, said alloy containing from about 5% to about 45% nickel; and subjecting said alloy to a final working step prior to said exposure to elevated temperatures, said working step comprising reducing said thickness from about 4% to about 30%.

2. The process of claim 1 wherein said working step comprises:

cold rolling said alloy to said reduced thickness.

3. The process of claim 1 wherein said working step comprises:

reducing said thickness from about 5% to about 25%.

4. The process of claim 1 wherein said alloy providing step comprises:

providing an alloy consisting essentially of about 5% to about 45% nickel, about 0.1% to about 1.1% manganese and the balance essentially copper.

5. The process of claim 1 wherein said alloy providing step comprises:

providing an alloy consisting essentially of about 5% to about 35% nickel, about 0.6% to about 1.0% manganese and the balance essentially copper.

6. The process of claim 1 wherein said alloy providing step comprises:

casting said copper alloy into an ingot; and cold working said alloy into a strip material having said first thickness.

7. The process of claim 6 further comprising:

hot working said ingot prior to said cold working step for forming said strip material.

8. The process of claim 7 further comprising:

subjecting said alloy to at least one heat treatment.

9. The process of claim 1 wherein said alloy providing step comprises:

providing an alloy having a grain size in the range of about 10μ to about 100μ.

10. The process of claim 1 further comprising:

fabricating said alloy into a desired article, said fabricating step including exposing said alloy to a heat treatment at an elevated temperature; and said alloy substantially maintaining said grain structure during said heat treatment.

11. A copper alloy produced by the process of claim 1.

12. A brazing process comprising:

providing an article formed from a copper base alloy consisting essentially of about 5% to about 45% nickel, about 0.1% to about 1.1% manganese and the balance essentially copper;

applying a filler material to said article; and heating said article and said filler material to a temperature sufficient to melt said filler material;

wherein the improvement comprises:

said article providing step including processing said alloy into a material having a desired thickness, a desired temper and a relatively fine grain structure; and subjecting said material to a final cold working step comprising reducing said material thickness from about 4% to about 30% to enable said alloy forming said material to substantially maintain said grain structure during said heating step.

13. The process of claim 12 wherein said final cold working step comprises reducing said thickness from about 5% to about 25%.

14. The process of claim 12 wherein said final cold working step comprises cold rolling said material.

15. The process of claim 12 wherein:

said alloy consists essentially of about 5% to about 35% nickel, about 0.6% to about 1% manganese and the balance essentially copper; and said alloy processing step including providing said material with an average grain size in the range of about 10μ to about 100μ.

16. The process of claim 12 further comprising:

providing a second metal or metal alloy article;

applying said filler material to said second article: and heating said articles to join them together.

17. The process of claim 12 wherein:

said filler material comprises a copper containing material; and said heating step comprises heating said article and said filler material to a temperature in the range of about 1065° C. to about 1125° C.

18. The process of claim 12 wherein said alloy processing step includes:

casting said alloy and forming an ingot; and cold working said ingot into said material.

19. The process of claim 18 wherein said alloy processing step further includes:

annealing said material at a temperature in the range of about 550° C. to about 900° C. for at least about one minute to about 24 hours.

20. The process of claim 18 wherein said alloy processing step further includes:

hot working said ingot prior to said cold working step for forming said material.

21. The process of claim 18 after further comprising:

said final cold working step being performed after said cold working step for forming said material and prior to said material being fabricated into said article.

22. The process of claim 19 further comprising:

said final cold working step being performed after said annealing step and prior to said material being fabricated into said article.

23. A brazed assembly, said assembly being formed by the process of claim 12.

* * * * *